US009771779B2

(12) United States Patent
Surjaatmadja et al.

(10) Patent No.: US 9,771,779 B2
(45) Date of Patent: Sep. 26, 2017

(54) JETTING TOOL FOR BOOSTING PRESSURES AT TARGET WELLBORE LOCATIONS

(71) Applicant: Halliburton Energy Services, Inc., Houston, TX (US)

(72) Inventors: Jim Basuki Surjaatmadja, Duncan, OK (US); Stanley V. Stephenson, Duncan, OK (US)

(73) Assignee: HALLIBURTON ENERGY SERVICE, INC., Houston, TX (US)

( * ) Notice: Subject to any disclaimer, the term of this patent is extended or adjusted under 35 U.S.C. 154(b) by 0 days.

(21) Appl. No.: 14/758,998

(22) PCT Filed: Sep. 15, 2014

(86) PCT No.: PCT/US2014/055617
§ 371 (c)(1),
(2) Date: Jul. 2, 2015

(87) PCT Pub. No.: WO2016/043699
PCT Pub. Date: Mar. 24, 2016

(65) Prior Publication Data

US 2016/0273313 A1 Sep. 22, 2016

(51) Int. Cl.
*E21B 41/00* (2006.01)
*E21B 43/26* (2006.01)
(Continued)

(52) U.S. Cl.
CPC ..... *E21B 41/0078* (2013.01); *E21B 33/12* (2013.01); *E21B 43/114* (2013.01); *E21B 43/26* (2013.01); *E21B 43/267* (2013.01)

(58) Field of Classification Search
CPC ... E21B 7/16; E21B 7/18; E21B 43/29; E21B 43/267; E21B 43/114
See application file for complete search history.

(56) References Cited

U.S. PATENT DOCUMENTS 2,807,442 A * 9/1957 Ledgerwood, Jr. ..... E21B 7/16 175/54
2,809,013 A * 10/1957 Ledgerwood, Jr. ..... E21B 7/16 175/317

(Continued)

FOREIGN PATENT DOCUMENTS

JP 2009085864 A 4/2009

OTHER PUBLICATIONS

International Search Report and Written Opinion for PCT/US2014/055617 dated Jun. 10, 2015.

*Primary Examiner* — Robert E Fuller
*Assistant Examiner* — Steven Macdonald
(74) *Attorney, Agent, or Firm* — McDermott Will & Emery LLP

(57) ABSTRACT

Well systems including a wellbore lined with a wellbore lining and a pressure booster extendable within the wellbore on a conveyance whereby an annulus is defined between the conveyance and the wellbore lining. The pressure booster includes a body having a first end coupled to the conveyance, a jetting chamber defined within the body, one or more flow ports defined in the body and providing fluid communication between the jetting chamber and the annulus, and a jet nozzle in fluid communication with the conveyance. The pressure booster receives a first fluid through the conveyance and a second fluid from the annulus and mixes the first and second fluids to discharge a fracturing fluid below the pressure booster at a pressure greater than a pressure within the annulus above the pressure booster.

7 Claims, 3 Drawing Sheets

(51) Int. Cl.

| | |
|---|---|
| ***E21B 33/12*** | (2006.01) |
| ***E21B 43/114*** | (2006.01) |
| ***E21B 43/267*** | (2006.01) |

(56) References Cited

U.S. PATENT DOCUMENTS

| | | | | |
|---|---|---|---|---|
| 2,841,365 | A * | 7/1958 | Ramsey | E21B 7/16 175/54 |
| 2,868,509 | A * | 1/1959 | Williams | E21B 7/16 175/400 |
| 2,885,184 | A * | 5/1959 | Deily | E21B 7/16 175/230 |
| 4,534,427 | A * | 8/1985 | Wang | B26F 3/004 175/104 |
| 5,765,642 | A | 6/1998 | Surjaatmadja | |
| 5,799,734 | A | 9/1998 | Norman et al. | |
| 6,662,874 | B2 | 12/2003 | Surjaatmadja et al. | |
| 6,719,954 | B2 | 4/2004 | Jansen | |
| 8,622,124 | B2 | 1/2014 | Eslinger | |
| 2010/0044041 | A1 | 2/2010 | Smith et al. | |
| 2011/0209869 | A1 | 9/2011 | Smith | |
| 2013/0098043 | A1 | 4/2013 | Surjaatmadja | |
| 2014/0158345 | A1 | 6/2014 | Jang et al. | |
| 2016/0084083 | A1 * | 3/2016 | Hice | E21B 7/18 299/1.05 |

* cited by examiner

JETTING TOOL FOR BOOSTING PRESSURES AT TARGET WELLBORE LOCATIONS

BACKGROUND

The present disclosure relates generally to wellbore stimulation in the oil and gas industry and, more particularly, to downhole tools that increase fluid pressures at intended localities within a wellbore.

To produce hydrocarbons (e.g., oil, gas, etc.) from a subterranean formation, wellbores may be drilled to penetrate hydrocarbon-bearing portions of the subterranean formation, commonly referred to as "production zones." In some instances, a subterranean formation penetrated by the wellbore may have multiple production zones or "production intervals" at various locations along the wellbore.

After a wellbore has been drilled to a desired depth, completion operations are performed. Such completion operations may include inserting a liner or casing into the wellbore and cementing the casing or liner into place. Once the wellbore is completed as desired, a stimulation operation may be performed to enhance hydrocarbon production from the surrounding production intervals into the wellbore. Examples of some common stimulation operations involve hydraulic fracturing, acidizing, fracture acidizing, and hydrajetting. Stimulation operations are intended to increase the flow of hydrocarbons into the wellbore from the surrounding subterranean formation so that the hydrocarbons may then be produced up to a wellhead.

In some applications, individual locations or spans of fractures may be created and spaced from each other at predetermined distances along the axial length of a wellbore. The multiple fracture locations provide corresponding production intervals that may be individually stimulated to increase hydrocarbon production. More particularly, each production interval can be hydraulically fractured by injecting a high pressure fracturing fluid containing a proppant into the fractures. The proppant comprises sized particles that penetrate into the fractures and hold the fractures open after the hydraulic fracturing treatment ceases. In wellbores that have axially adjacent production intervals, it can sometimes be difficult to convey high pressure fracturing fluids into one production interval where a high pressure fracturing treatment is desired, while avoiding over-pressurization of the adjacent production interval where increased fluid pressures could potentially damage the adjacent production interval.

BRIEF DESCRIPTION OF THE DRAWINGS

The following figures are included to illustrate certain aspects of the present disclosure, and should not be viewed as exclusive embodiments. The subject matter disclosed is capable of considerable modifications, alterations, combinations, and equivalents in form and function, without departing from the scope of this disclosure.

DETAILED DESCRIPTION

The present disclosure relates generally to wellbore stimulation in the oil and gas industry and, more particularly, to downhole tools that increase fluid pressures at intended localities within a wellbore.

The embodiments provided herein describe a pressure booster in the form of a jetting tool that allows a well operator to selectively hydraulically fracture a subterranean formation with a high-pressure fracturing fluid, while simultaneously isolating other sensitive portions of the wellbore, such as an adjacent formation or a wellhead. This may prove advantageous in preventing over-pressurization of the adjacent formation or the wellhead. The pressure booster may include a jet nozzle that receives a first fluid a first velocity and a first pressure, while a second fluid may be communicated to the pressure booster a second velocity and a second pressure via an annulus defined in a wellbore, where the first velocity is less than the second velocity, and the first pressure is greater than the second pressure. The jet nozzle may discharge the first fluid at a third velocity greater than the first and second velocities and thereby draw the second fluid into a jetting chamber to mix with the first fluid and form the fracturing fluid. The fracturing fluid may be discharged from the pressure booster at a third pressure, which is greater than second pressure in the annulus. As a result, the fracturing fluid may be used to hydraulically fracture a formation while an adjacent formation or a wellhead may be substantially isolated from the elevated third pressure.

Figure 1:
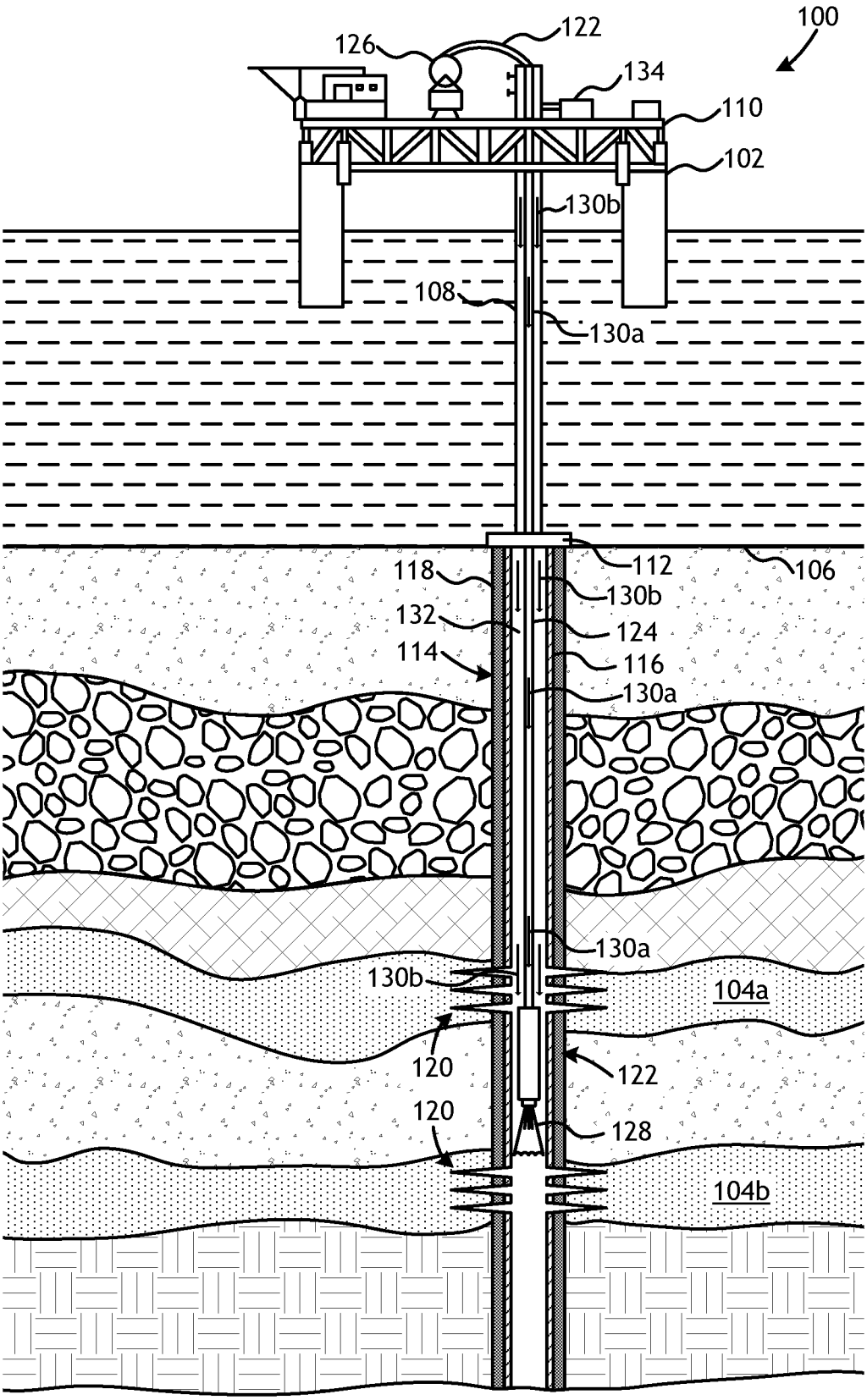
FIG. 1 is a schematic diagram of an offshore oil and gas rig that may employ one or more principles of the present disclosure.

Referring to FIG. 1, illustrated is an exemplary well system 100 that may employ one or more principles of the present disclosure, according to one or more embodiments. As illustrated, the well system 100 may include a semi-submersible platform 102 centered over one or more submerged oil and gas formations 104, shown as a first formation 104*a* and a second formation 104*b*, located below the sea floor 106. Even though FIG. 1 generally depicts an offshore oil and gas platform 102, those skilled in the art will readily recognize that the well system 100 may alternatively be well suited for use in or on other types of service rigs, such as land-based rigs or rigs located at any other geographical site. In yet other embodiments, the platform 102 may be replaced with a land-based wellhead installation, without departing from the scope of the disclosure.

A subsea conduit or riser 108 extends from the deck 110 of the platform 102 to a wellhead installation 112 arranged at or near the sea floor 106. As depicted, a wellbore 114 extends from the sea floor 106 and has been drilled through various earth strata, including the various submerged oil and gas formations 104*a,b*. A wellbore liner 116 is at least partially cemented within the main wellbore 114 with cement 118. The term "wellbore liner" is used herein to designate any type of tubular string or conduit used to line the wellbore 114. The wellbore liner 116 may be, for example, "casing" or "liner," as known in the art, and may be segmented or continuous.

As illustrated, the wellbore liner 116 may have multiple perforations 120 defined or otherwise formed therein at one or more locations to facilitated fluid communication between the first and second formations 104*a,b* and the wellbore 114. The perforations 120 associated with the first formation 104*a* may provide a first production interval in the wellbore 114, while the perforations 120 associated with the second formation 104*b* may provide a second production interval in the wellbore 114. During the viable life of the well, hydrocarbons may be extracted from the first and second production intervals and produced to the platform 102 for processing via the wellbore 114 and the riser 108.

To extend the life of the well and enhance hydrocarbon production, the hydrocarbon-bearing formations 104*a,b* may be stimulated via one or more hydraulic fracturing treatments. To accomplish this, according to embodiments of the present disclosure, the well system 100 may further include a jetting tool or pressure booster 122 that may be introduced into the wellbore 114. In some embodiments, as illustrated, the pressure booster 122 may be lowered into the wellbore 114 on a conveyance 124. The conveyance 124 may be, for example, coiled tubing (also referred to as "coil" tubing), which may be fed into the wellbore 114 from a spool or reel 126 arranged on the deck 110 of the platform 102. The conveyance 124 may alternatively be any rigid or semi-rigid conduit, such as production pipe or drill pipe. In other embodiments, as described below, the conveyance 124 may be omitted from the well system 100 and the pressure booster 122 may instead form part of the wellhead 112 and may provide fluid communication with the wellbore 114 below the wellhead 112.

In some embodiments, the pressure booster 122 may be configured to eject a fracturing fluid 128 into the wellbore 114 below the pressure booster 122. As described below, the pressure booster 122 may include a jet nozzle (not shown) that receives a high-pressure, low flowrate first fluid 130*a* via the conveyance 124. As the first fluid 130*a* is discharged from the jet nozzle, a pressure differential is generated across the pressure booster 122, which results in a low-pressure, high flowrate second fluid 130*b* being drawn into the pressure booster 122 from an annulus 132 defined between the conveyance 124 and the wellbore liner 116. The second fluid 130*b* may be provided into the annulus 132 from a source 134, such as a reservoir or holding tank, arranged either on the platform 102 or at or near the wellhead 112. The first and second fluids 130*a,b* may mix within the pressure booster 122 to form the fracturing fluid 128, which is subsequently ejected into the wellbore 114 below the pressure booster 122 at a fluid pressure that is greater than the fluid pressure within the annulus 132.

As will be appreciated, the pressure booster 122 may prove advantageous in allowing a well operator to selectively hydraulically fracture a subterranean formation with a high-pressure fracturing fluid 128, while simultaneously isolating other sensitive formations that may be over-pressurized and damaged with the high-pressure fracturing fluid 128. For example, in at least one embodiment, the pressure booster 122 may be located within the wellbore 114 between the first and second formations 104*a,b*, as illustrated. As located between the first and second formations 104*a,b*, the jetting may be configured to discharge the high-pressure fracturing fluid 128 into the second formation 104*b* via the corresponding fractures 120 and substantially isolate the first formation 104*a* from the high-pressure fracturing fluid 128. As a result, the first formation 104*a* may only be exposed to the fluid pressure of the second fluid 130*b* within the annulus 132.

As used herein, the term "fracturing fluid," or variations thereof, refers to a mixture of a clean fluid and a proppant slurry in any proportion. The term "proppant slurry," or variations thereof, refers to a proppant-carrying fluid that is a mixture of a granular solid, such as sand, with a liquid, such as water or a gel. The proppant slurry may be any mixture capable of suspending and transporting proppant in concentrations above about 12 pounds of proppant per gallon of proppant slurry. The proppant slurry must have a proppant concentration that is the highest possible desired concentration of proppant in a mixture of proppant and clean fluid that might be needed during a particular job. In certain embodiments, the proppant slurry may contain up to 27 pounds of granular solid per gallon of fluid. In certain embodiments, the proppant slurry may also include other substances such as viscosity modifiers, thickeners, etc. In one exemplary embodiment, the proppant slurry may be LIQUIDSAND™, which is commercially available from Halliburton Energy Services, Inc., of Houston, Tex. and disclosed and described in U.S. Pat. No. 5,799,734.

The proppant slurry may comprise a granular solid such as sized sand, resin-coated sand, sintered bauxite beads, metal beads or balls, ceramic particles, glass beads, polymer resin beads, ground nut shells, and the like. In certain embodiments, a portion of the proppant may be a bio-degradable material, so as to provide improved permeability. In certain embodiments, the bio-degradable portion may be 5%-90% as designed by the user of the process.

The proppant slurry may also comprise any water-containing fluid that does not adversely react with the subterranean formation or the other fluid constituents. For example, the fluid can comprise an aqueous mineral or organic acid, an aqueous salt solution such as a potassium chloride solution, ammonium chloride solution, an aqueous organic quaternary ammonium chloride solution, any combination thereof, or the like.

In certain embodiments, the proppant slurry may comprise a gelling agent that may comprise substantially any viscosifying compound known to function in a desired manner. The gelling agent can comprise, for example, any polysaccharide polymer viscosifying agent such as guar gum, derivatized guars such as hydroxypropylguar, derivatized cellulosics such as hydroxyethylcellulose, derivatives of starch, polyvinyl alcohols, acrylamides, xanthan gums, and the like. A specific example of a suitable gelling agent is guar, hydroxypropylguar, or carboxymethyl hydroxypropylguar present in an amount of from about 0.2 to about 0.75 weight percent in the fluid.

As used herein, the term "clean fluid" or variations thereof refer to a fluid that does not have significant amounts of proppant or other solid materials suspended therein. Clean fluids may include most brines, including fresh water. The brines may sometimes contain viscosifying agents or friction reducers. The clean fluid may also be an energized fluid, such as foamed or comingled brines with carbon dioxide or nitrogen, acid mixtures or oil, based fluids and emulsion fluids. A clean fluid may be a gel, a liquid, or a gas, such as $CO_2$ or $N_2$.

Figure 2:
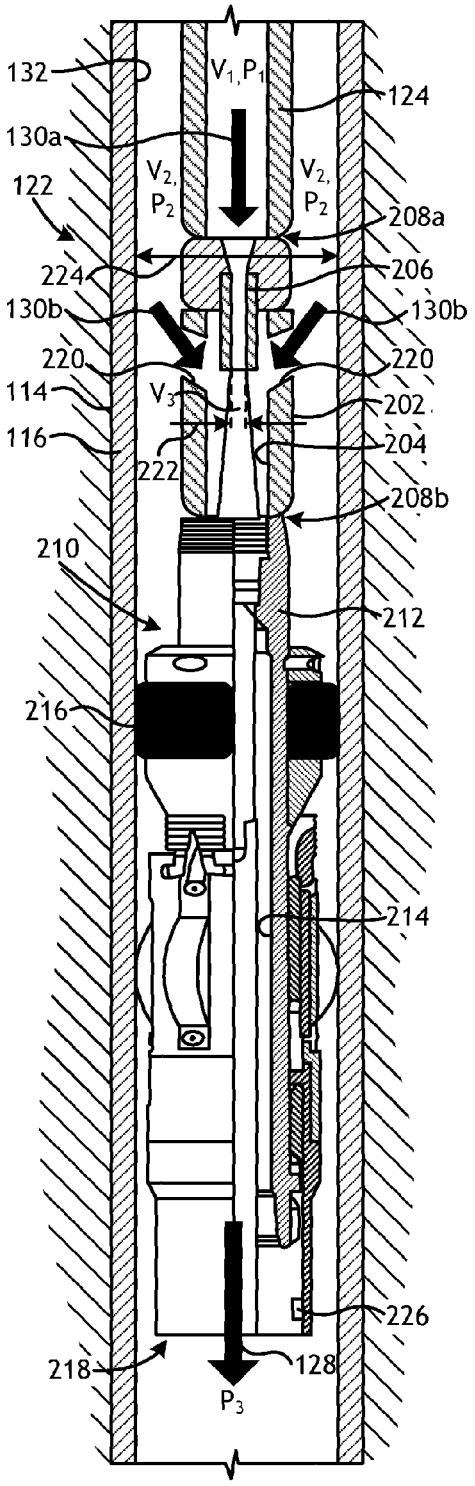
FIG. 2 depicts an enlarged partial cross-sectional side view of the one embodiment of the pressure booster of FIG. 1.

Referring now to FIG. 2, with continued reference to FIG. 1, illustrated is an enlarged cross-sectional side view of one embodiment of the pressure booster 122, according to at least one embodiment of the present disclosure. Reference numerals from FIG. 1 that are used in FIG. 2 refer to similar components or elements that will not be described again. In the illustrated embodiment, the pressure booster 122 is depicted as being arranged within the wellbore 114 lined with the wellbore liner 116 and lowered within the wellbore 114 using the conveyance 124.

The pressure booster 122 may include a body 202, a jetting chamber 204 defined within the body 202, and a jet nozzle 206 in fluid communication with the conveyance 124. The body 202 may have a first or upper end 208*a* and a second or lower end 208*b*. The first end 208*a* of the body 202 may be coupled to the conveyance 124. In some embodiments, for instance, the first end 208*a* may be threaded to the conveyance 124. In other embodiments, however, the first end 208*a* of the body 202 may be mechanically fastened to the conveyance 124, such as by using one or more mechanical fasteners, pins, or snap rings, or may alternatively be welded and/or brazed to the conveyance 124, without departing from the scope of the disclosure.

In some embodiments, a sealing system 210 may be coupled or otherwise attached to the second end 208*b* of the body 202. In other embodiments, however, the sealing system 210 may be omitted, without departing from the scope of the disclosure. The sealing system 210 may include an elongate housing 212 that defines a central flow passageway 214 and at least one wellbore isolation device 216 arranged about the housing 212. The housing 212 may be coupled to the second end 208*b* of the body 202 via a variety of attachment means including, but not limited to, a threaded engagement, one or more mechanical fasteners (e.g., bolts, screws, pins, snap rings, etc.), welding, brazing, any combination thereof, and the like. The central flow passageway 214 may fluidly communicate with the jetting chamber 204, and a lower or distal end 218 of the central flow passageway 214 may be open to the wellbore 114 such that fluids discharged from the pressure booster 122 may be conveyed through the sealing system 210 and eventually discharged into the wellbore 114 via the central flow passageway 214.

The wellbore isolation device 216 may comprise any type or configuration of wellbore packer or packing element configured to expand and sealingly engage the inner wall of the wellbore liner 116 upon actuation. In some embodiments, the sealing system 210 may be a compression-set packer assembly that may be activated or set by applying a compressive force on the wellbore isolation device 216. In at least one embodiment, the sealing system 210 may be a COBRA FRAC® RR4 EV multi-set compression packer available from Halliburton Energy Services, Inc., of Houston, Tex. In other embodiments, however, the sealing system 210 may be a tension set packer assembly or any electrically or hydraulically controlled packer systems, without departing from the scope of the disclosure. When properly actuated, the wellbore isolation device 216 may provide a fluid seal against the inner wall of the wellbore liner 116 such that fluid migration in either direction past the wellbore isolation device 216 is substantially or entirely prevented. While the wellbore isolation device 216 can be construed as a total sealing device, such as a well packer (which negates the need for a pressure enhancer device), it can alternatively be a flow limiting device, such as a "cup sealer," which comprises an elastomeric cup that does not absolutely seal between the top and bottom regions, or any other limiters known in the industry.

The body 202 may define or otherwise provide one or more flow ports 220 (two shown) that facilitate fluid communication between the jetting chamber 204 and the annulus 132 defined between the conveyance 124 and the wellbore liner 116. The jet nozzle 206 may facilitate fluid communication between the conveyance 124 and the jetting chamber 204. In some embodiments, the jet nozzle 206 may be made of an erosion-resistant material, such as a carbide (e.g., tungsten, titanium, tantalum, boron, or vanadium), a carbide embedded in a matrix of cobalt or nickel by sintering, a cobalt alloy, a ceramic, a surface hardened metal (e.g., nitrided metals, heat-treated metals, carburized metals, hardened steel, etc.), diamond, or any combination thereof. In at least one embodiment, the jet nozzle 206 may comprise a ROCTEC® 500 carbide sandblasting nozzle commercially available through Kennametal of Traverse City, Mich., USA.

The jet nozzle 206 may exhibit a cross-sectional area 222 that is a fraction of a cross-sectional area 224 of the wellbore liner 116. In some embodiments, for instance, the cross-sectional area 222 of the jet nozzle 206 may range between about $1/5^{th}$ and about $1/25^{th}$ the cross-sectional area 224 of the wellbore liner 116. In other embodiments, the cross-sectional area 222 of the jet nozzle 206 may range between about $1/10^{th}$ and about $1/20^{th}$ the cross-sectional area 224 of the wellbore liner 116. In at least one embodiment, the cross-sectional area 222 of the jet nozzle 206 may be about $1/15^{th}$ the cross-sectional area 224 of the wellbore liner 116.

In exemplary operation, the pressure booster 122 may be introduced into the wellbore liner 116 and conveyed to a target location within the wellbore 114. Once reaching the target location within the wellbore 114, the sealing system 210 (if used) may be actuated or activated to sealingly engage the wellbore isolation device 216 against the inner wall of the wellbore liner 116, as discussed above. With the wellbore isolation device 216 engaged against the inner wall of the wellbore liner 116, the first fluid 130*a* may be communicated to the pressure booster 122 and, more particularly, to the jet nozzle 206 via the conveyance 124. The second fluid 130*b* may be communicated to the pressure booster 122 via the annulus 132. In some embodiments, the first fluid 130*a* is a proppant slurry and the second fluid 130*b* is a clean fluid. In other embodiments, however, the first fluid 130*a* may be the clean fluid, and the second fluid 13*b* may be the proppant slurry, without departing from the scope of the disclosure.

The first fluid 130*a* may be circulated through the conveyance 124 at a first velocity $V_1$ and a first pressure $P_1$, while the second fluid 130*b* may be circulated through the annulus 132 at a second velocity $V_2$ and a second pressure $P_2$. The first velocity $V_1$ may be less than the second velocity $V_2$, and the first pressure $P_1$ may be greater than the second pressure $P_2$. At the jet nozzle 206, the first fluid 130*a* may be discharged into the jetting chamber 204 at a third velocity $V_3$ that is greater than the second velocity $V_2$ and much greater than the first velocity $V_1$. In accordance with Bernoulli's principle, ejecting the first fluid 130*a* into the jetting chamber 204 at the third velocity $V_3$ may result in a pressure differential being generated across the pressure booster 122 and otherwise within the jetting chamber 204. The pressure differential may result in a Venturi effect that draws the second fluid 130*b* into the jetting chamber 204 via the flow ports 220, and allows the first and second fluids 130*a,b* to mix and thereby form the fracturing fluid 128. The fracturing fluid 128 may then be conveyed through the sealing system 210 and eventually discharged into the wellbore 114 via the central flow passageway 214 at a third pressure $P_3$, which is greater than second pressure $P_2$ in the annulus 132. The fracturing fluid 128 may then be used to hydraulically fracture a portion of the wellbore 114, such as either of the first or second formations 104*a,b* of FIG. 1 depending on the location of the pressure booster 122.

In some embodiments, the pressure booster 122 may include one or more pressure transducers or sensors 226 for measuring and reporting the third pressure $P_3$ to a surface location. In response to the measured third pressure $P_3$, a well operator may decide to undertake one or more corrective or optimizing actions, such as increasing or decreasing first or second velocities $V_1$, $V_2$ of the first and second fluid 130*a,b*, respectively.

In an example embodiment where the cross-sectional area 222 of the jet nozzle 206 is about $1/15^{th}$ the cross-sectional area 224 of the wellbore liner 116, the first velocity $V_1$ of the first fluid 130*a* within the conveyance may be conveyed at less than or equal to 35 feet per second (ft/sec). As a result, the third velocity $V_3$ of the first fluid 130*a* as ejected from the jet nozzle 206 may be about 525 ft/sec, which serves to draw in the second fluid 130*b* from the annulus 132 via the flow ports 220 and generate the fracturing fluid 128 at the third pressure $P_3$. In some embodiments, the third pressure $P_3$ can be about 3,000 psi greater than the second pressure $P_2$ within the annulus 132.

Referring briefly again to FIG. 1, with continued reference to FIG. 2, the above described operation may prove advantageous in selectively undertaking hydraulic fracturing operations in the second production interval of the second formation 104*b* at the third pressure $P_3$ while substantially isolating the first production interval of the first formation 104*a* from the third pressure $P_3$. More particularly, the first and second formations 104*a,b* may be isolated from each other with the sealing system 210. As a result, the second formation 104*b* may be hydraulically fractured with the fracturing fluid 128 at the third pressure $P_3$ while the first formation 104*a* may be exposed only to the lower second pressure $P_2$ from the annulus 132.

In some embodiments, the pressure booster 122 may further include a J-slot activated valve (not shown). The J-slot activated valve may prove useful in allowing a well operator to reverse the direction of the fracturing fluid 128 at the third pressure $P_3$ within the wellbore 114 such that the fracturing fluid 128 is able to hydraulically fracture the first formation 104*a* while the second formation 104*b* is substantially isolated using the sealing system 210. The J-slot activated valve may be actuated by latching between a first position, where the pressure booster 122 ejects the fracturing fluid 128 within the wellbore 114 below the pressure booster 122, and a second position, where the pressure booster 122 ejects the fracturing fluid 128 within the wellbore 114 above the pressure booster 122.

Referring again to FIG. 2, the first and third velocities $V_1$, $V_3$ of the first fluid 130*a* may be important in embodiments where the first fluid 130*a* comprises the proppant slurry and the second fluid 130*b* comprises the clean fluid. More particularly, the slower first velocity $V_1$, as compared to the faster second velocity $V_2$ of the second fluid 130*b*, may help mitigate damage to the conveyance 124 as the solid particulates suspended within the proppant slurry of the first fluid 130*a* engage and erode the inner surfaces of the conveyance 124. As a result, the slower first velocity $V_1$ may prove advantageous in prolonging the useful life of the conveyance 124. Moreover, in some embodiments, the third velocity $V_3$ may be less than or equal to 525 ft/sec, above which weak proppant in the proppant slurry has a tendency to explode as passing through the jet nozzle 206.

In alternative embodiments, as indicated above, the first fluid 130*a* may be the clean fluid and the second fluid 130*b* may be the proppant slurry. In such embodiments, a greater amount of fluid friction may be generated within the annulus 132 as the proppant slurry (e.g., the second fluid 130*b*) circulates to the pressure booster 122. The clean fluid (e.g., the first fluid 130*a*), however, may be ejected out of the jet nozzle 206 at much greater velocities (i.e., the third velocity $V_3$) since there is reduced risk of eroding the jet nozzle 206 with clean fluid. As a result, the useful life of the jet nozzle 206 may be extended.

While the jet nozzle 206 is shown in FIG. 2 as being generally positioned above the wellbore isolation device 216, it could equally be positioned below the wellbore isolation device 216. For instance, in at least one embodiment, the jet nozzle 206 may extend through the jetting chamber 204, at least partially into the central flow passageway 214, and axially past the location of the wellbore isolation device, without departing from the scope of the present disclosure. As will be appreciated, such a configuration may prove advantageous since often a lower formation (e.g., the second formation 104*b* if FIG. 1) may be pressurized, while an upper formation (e.g., the first formation 104*a* of FIG. 1) is depleted.

Figure 3:
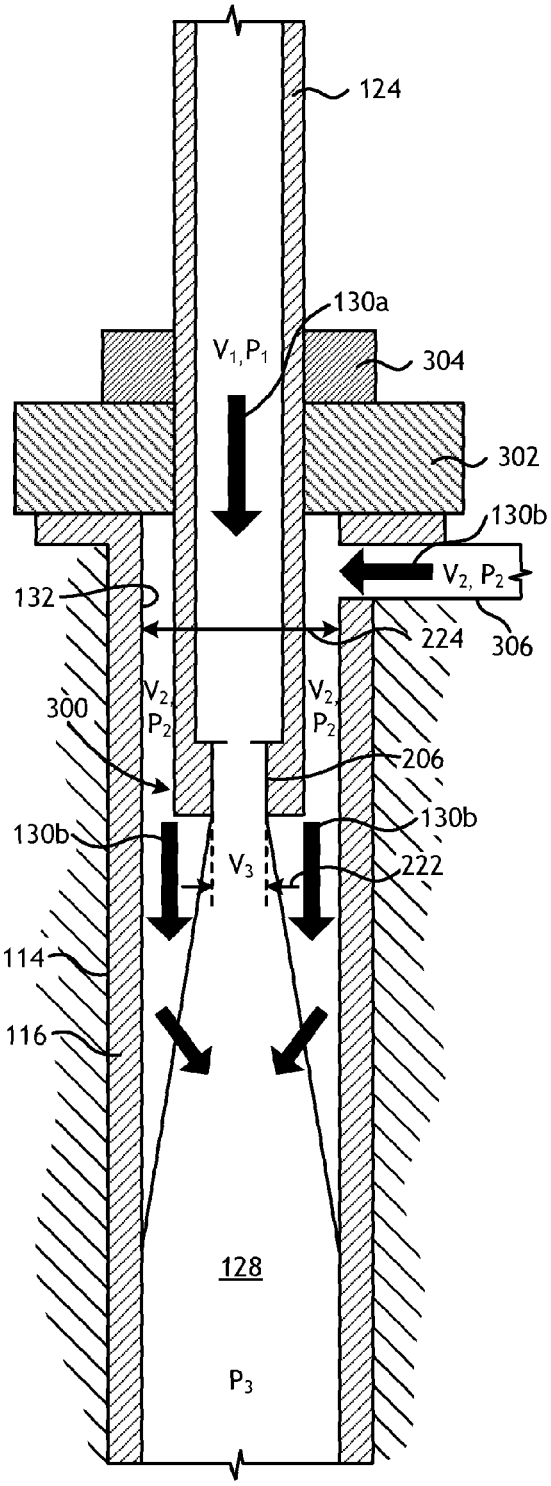
FIG. 3 is an enlarged cross-sectional side view of another exemplary pressure booster.

Referring now to FIG. 3, with continued reference to the prior figures, illustrated is an enlarged cross-sectional side view of another exemplary pressure booster 300, according to one or more embodiments of the present disclosure. The pressure booster 300 may be a jetting tool similar in some respects to the pressure booster 122 of FIGS. 1 and 2, where like numerals correspond to like elements and components that will not be described again. Similar to the pressure booster 122 of FIGS. 1 and 2, the pressure booster 300 may be generally arranged within and otherwise in fluid communication with the wellbore 114 lined with the wellbore liner 116. Moreover, the pressure booster 300 may also include the jet nozzle 206 configured to receive the first fluid 130*a* from the conveyance 124.

Unlike the pressure booster 122 of FIGS. 1 and 2, however, the pressure booster 300 may be coupled to a wellhead 302, which may include, in at least one embodiment, a frac head 304. More particularly, the conveyance 124 of the pressure booster 300 may extend through and otherwise penetrate the wellhead 302 and the frac head 304. In some embodiments, the wellhead 302 may be the same as or similar to the wellhead 112 of FIG. 1. In other embodiments, however, the wellhead 302 may be different, such as being positioned at a surface location as opposed to subsea at the sea floor 106 (FIG. 1). In such embodiments, the conveyance 124 may be any piping or fluid conduit configured to communicate the first fluid 130*a* to the jet nozzle 206. The second fluid 130*b* may be conveyed into the annulus 132 via one or more fluid conduits 306 (one shown) in fluid communication with the annulus 132 and positioned below the wellhead 302. The second fluid 130*b* may be provided to the fluid conduits 306 from a source, such as the source 134 of FIG. 1 (e.g., a reservoir or holding tank for the second fluid 130*b*) or from a water truck at a surface location, or may alternatively comprise in-situ filtered seawater from the sea floor 106 (FIG. 1), if so desired.

As described above, the jet nozzle 206 may exhibit the cross-sectional area 222 that is a fraction of the cross-sectional area 224 of the wellbore liner 116. For example, the cross-sectional area 222 of the jet nozzle 206 may range between about $1/5^{th}$ and about $1/25^{th}$ or between about $1/10^{th}$ and about $1/20^{th}$ the cross-sectional area 224 of the wellbore liner 116 and, in at least one embodiment, the cross-sectional area 222 of the jet nozzle 206 may be about $1/15^{th}$ the cross-sectional area 224 of the wellbore liner 116.

In exemplary operation, the first fluid 130*a* may be communicated to the pressure booster 300 and, more particularly, to the jet nozzle 206 via the conveyance 124, and the second fluid 130*b* may be communicated to the pressure booster 300 within the annulus 132 via the fluid conduit(s) 306. In some embodiments, the first fluid 130*a* may be the proppant slurry and the second fluid 130*b* may be the clean fluid, but this may be reversed in other applications, without departing from the scope of the disclosure.

The first fluid 130*a* may be circulated through the conveyance 124 at the first velocity $V_1$ and at the first pressure $P_1$, while the second fluid 130*b* may be circulated within the annulus 132 at the second velocity $V_2$ and the second pressure $P_2$, where the first velocity $V_1$ is less than the second velocity $V_2$ and the first pressure $P_1$ is greater than the second pressure $P_2$. At the jet nozzle 206, the first fluid 130*a* may be discharged into the wellbore 114 at the third velocity $V_3$, which may be greater than the second velocity $V_2$ and much greater than the first velocity $V_1$. This may result in a pressure differential being generated across the pressure booster 300 and, as a result, the second fluid 130*b* may be drawn into the annulus 132 and otherwise toward the jet nozzle 206 to mix with the first fluid 130*a* and thereby form the fracturing fluid 128. The fracturing fluid 128 may then be conveyed downhole within the wellbore 114 at the third pressure $P_3$, which is greater than second pressure $P_2$ in the annulus 132. In some embodiments, the fracturing fluid 128 may then be used to hydraulically fracture one or more production intervals within the wellbore 114 below the wellhead 302, such as either of the first or second formations 104*a,b* of FIG. 1.

As will be appreciated, the above-described embodiment may prove advantageous in protecting the wellhead 302, which may be a low-pressure wellhead. For example, in some embodiments, the wellhead 302 may be rated to withstand a fluid pressure at or below 5,000 psi, but it may be desired to hydraulically fracture a particular production interval below the wellhead 302 at a fluid pressure of about 8,000 psi. This may be accomplished using the pressure booster 300 described above, without risking blowing out the wellhead 302. More particularly, by virtue of Bernoulli's principle, the jetted fracturing fluid 128 may generate a downward suction and, if the pressure differential across the jet is greater than 8,000 psi−5,000 psi (plus some constant to counteract losses or inefficiencies), then the pressure requirement for the wellhead 302 can be reduced by 3000 psi or more.

Referring now to FIG. 4, with reference again to FIG. 2, illustrated is an enlarged cross-sectional side view of another embodiment of the pressure booster 122, according to at least one embodiment of the present disclosure. Reference numerals from FIGS. 1 and 2 that are used in FIG. 4 refer to similar components or elements that will not be described again. In the illustrated embodiment, the pressure booster 122 is depicted as being arranged within the wellbore 114 lined with the wellbore liner 116 and lowered within the wellbore using the conveyance 124. The pressure booster 122 includes the body 202, the jetting chamber 204, and the jet nozzle 206, as generally described above.

Figure 4:
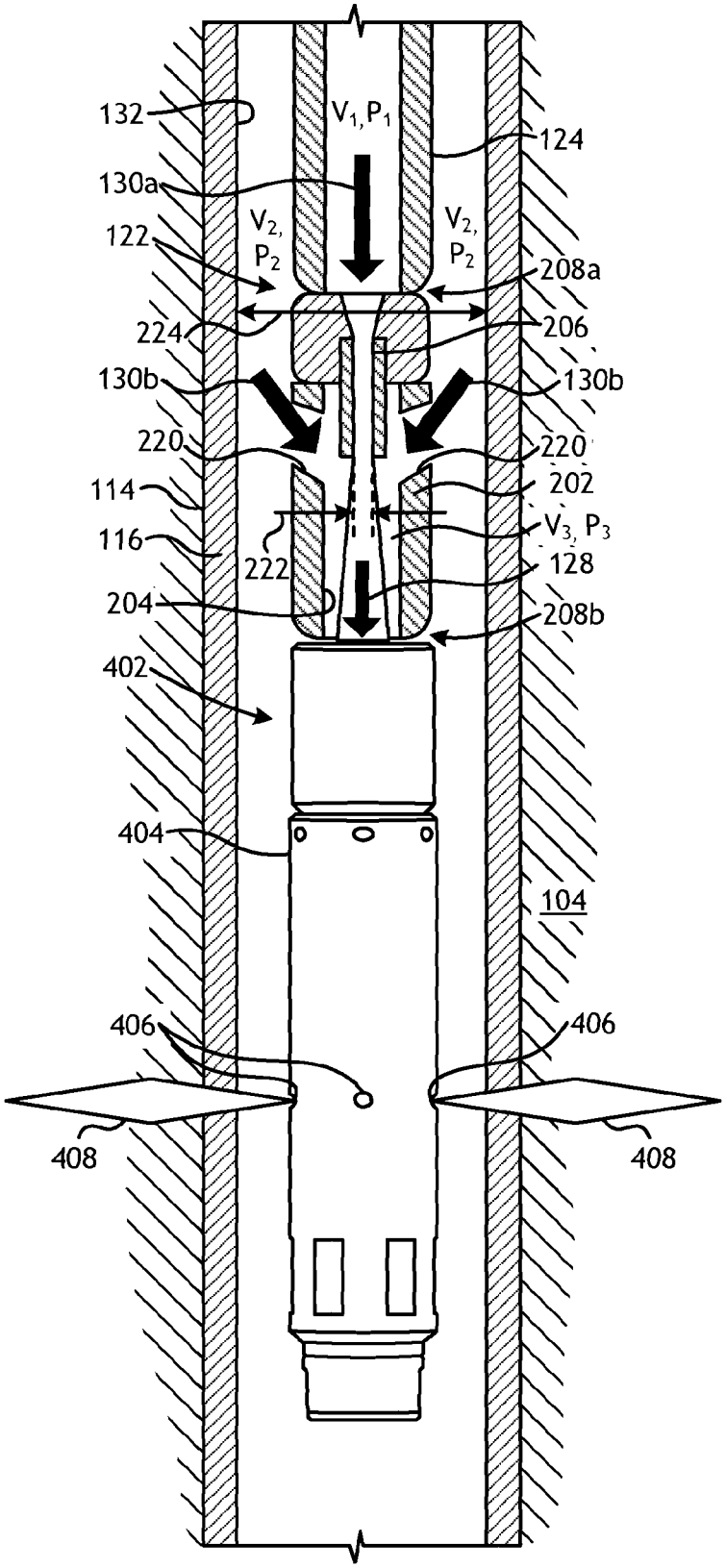
FIG. 4 is an enlarged cross-sectional side view of another embodiment of the pressure booster of FIG. 1.

Unlike the embodiment of FIG. 2, however, the sealing system 210 is omitted from the pressure booster 122 in FIG. 4 and alternatively replaced with a jet fracturing system 402, which is commonly used in the Halliburton SURGIFRAC® process (and also called a SURGIFRAC® tool). The jet fracturing system 402 may be coupled or otherwise attached to the second end 208*b* of the body 202. More particularly, the jet fracturing system 402 may include a jetting body 404 that may be coupled to the second end 208*b* via a variety of attachment means including, but not limited to, a threaded engagement, one or more mechanical fasteners (e.g., bolts, screws, pins, snap rings, etc.), welding, brazing, any combination thereof, and the like. A plurality of jets 406 (three shown) may be provided in the jetting body 404 and each may be configured to discharge a fluid jet 408 (two shown) laterally and in the direction of the wellbore liner 116. The fluid jets 408 may exhibit sufficient fluid pressure to penetrate the wellbore liner 116 and extend into the surrounding subterranean formation 104. In at least one embodiment, the jet fracturing system 402 may be the SURGIFRAC® tool, which is commercially available from Halliburton Energy Services, Inc., of Houston, Tex.

In exemplary operation, the pressure booster 122 may be introduced into the wellbore liner 116 and conveyed to a target location within the wellbore 114. Once reaching the target location within the wellbore 114, the first fluid 130*a* may be communicated to the pressure booster 122 and, more particularly, to the jet nozzle 206 via the conveyance 124. The second fluid 130*b* may be communicated to the pressure booster 122 via the annulus 132. As with prior embodiments, the first fluid 130*a* may be either the proppant slurry or the clean fluid while the second fluid 130*b* may be the other of the proppant slurry or the clean fluid. The first fluid 130*a* is circulated through the conveyance 124 at the first velocity $V_1$ and the first pressure $P_1$, while the second fluid 130*b* is circulated through the annulus 132 at the second velocity $V_2$ and the second pressure $P_2$, where the first velocity $V_1$ is less than the second velocity $V_2$, and the first pressure $P_1$ is greater than the second pressure $P_2$.

At the jet nozzle 206, the first fluid 130*a* may be discharged into the jetting chamber 204 at the third velocity $V_3$, which is greater than the second velocity $V_2$ and much greater than the first velocity $V_1$. A pressure differential may then be generated across the pressure booster 122 and otherwise within the jetting chamber 204, thereby resulting in the second fluid 130*b* being drawn into the jetting chamber 204 via the flow ports 220 via a Venturi effect. The first and second fluids 130*a,b* may mix within or below the jetting chamber 204 to form the fracturing fluid 128, which may be conveyed into the jetting body 404 of the jet fracturing system 402 at the third pressure $P_3$, which is greater than second pressure $P_2$ in the annulus 132. The fracturing fluid 128 may then be jetted out of the jetting body 404 via the jets 406, thereby resulting in the fluid jets 408 penetrating the wellbore liner 116 and a portion of the surrounding subterranean formation 104. In at least one embodiment, the jets 406 may comprise special, high-efficiency jets that are able to withstand elevated pressures and fracturing fluids 128.

While use of the principles of the present disclosure in the SURGIFRAC® application described above may be limited, it does offer a unique pressure limiting capability above that which is capable of the SURGIFRAC® tool by itself. If, for instance, a well service operator is required to use a tubular conveyance system that is large, large friction forces may be generated by the large conveyance system between a first formation (e.g., the first formation 104*a* of FIG. 1) and a second formation (e.g., the second formation 104*b* of FIG. 1) that is to be hydraulically fractured. In such an embodiment, pumping into the annulus 132 to help the fracture to initiate in the second formation 104*b* will cause the fracture to start in the first (top) formation 104*a*.

By placing the pressure booster 122 and jet fracturing system 402 slightly below the first formation 104, the following process or methodology may be followed. First, determine the depths and pressures required to fracture the formations 104*a* and 104*b*. For purposes of the present example, the depth of the first formation 104*a* is assumed to be 7000 ft, and the flow ports 220 would be located at or slightly below the first formation 104*a*. The fracture gradient in the present example is estimated to be at 0.6, thereby resulting in a fracturing pressure of 4200 psi. Lastly, the depth of the second formation 104*b* is assumed to be 8000 ft. In this example, an extension tool or sub that is about 1000 ft long may be added to the jet fracturing system 402, thereby placing the fracture location in the second formation 104*b* at the locations of the fluid jets 408. The fracture gradient of the second formation is estimated at 0.9 and, therefore, fracturing pressure is 7200 psi.

If there is no fluid communication between the first and second formations 104*a,b*, the pressure at the first formation 104*a* will be 6850 psi; 7200 psi−450 psi, and 450 psi being the hydrostatic difference (1000*0.45, i.e., the fluid gradient, in psi/ft). Consequently, with no help from any sealing devices, such as the sealing system 210 of FIG. 2, formation 104*b* is unable to be hydraulically fractured since any fluid pumped into it will just flow into the first formation 104*a*. For sake of this discussion, it is assumed that the fracture extension pressure into the second formation 104*b* is 0.8; which is still higher than the fracturing pressure of the first formation 104*a*, mainly due to formation fluid pressure.

In such circumstances, the jet fracturing system 402 (i.e., the SURGIFRAC® tool) is often used. The jet fracturing system 402 may be advantageous in using Bernoulli's principle to dynamically seal between the first and second formations 104*a,b*. There is an important difference between the Bernoulli effect in an enclosed space (cavity of a pump, a pipe or a perforation) and in an open space (expanded space, into a fracture, etc., where flow can go back to the source). Efficiency of the effect in closed spaces could be near 90%, whereas, in open spaces this may drop to 50% or even less, especially in open hole completions, and depending upon other situations. This efficiency is determined based upon "net" delivery, so flow back is "negative"; delivery in totally open spaces is 0%, i.e., everything is returned back. Therefore, in fracture initiations, the jet fracturing system 402 may use annular flow to help pressurize the annulus and reduce add fluids into the fracture. The jet fracturing system 402 may be configured to deliver an extra 2650 psi to the second formation 104*b* in order that the fracturing pressure does not open a fracture at the first formation 104*a*. With an efficiency of 80% (being conservative), a well operator would at least need a 3400 psi jet pressure to deliver this. To extend the fracture, the well operator would need about 6400−4200 psi; with an efficiency of 40% (assuming open hole), the well operator would need about 5500 psi jet pressure. At this time, it is assumed that the pressure booster 122 is not used). By reducing the annular space between the conveyance 124 and the casing 116, fluid moving from the second formation 104*b* to the first formation 104*a* will be restricted by friction. As a result, the effectiveness of the jet fracturing system 402 process in this case will be improved considerably.

Now, incorporation and use of the pressure booster 122 is considered. For this example, it is assumed that there are eight jets 406 that are 0.25" diameter. At 5500 psi jet pressure, each jet 406 will flow about 2.9 barrels per minute (BPM), thus about 26.5 BPM total. It is assumed that the pressure booster 122 is about 90% effective and a jet nozzle 206 exhibiting a 0.6875" diameter is used. To handle the 90% efficiency, pumping commences at pressures of 6110 psi. The resulting jet ejected out of the jet nozzle 206 creates a local vacuum, causing the second fluid 130*b* to enter the pressure chamber 204 through flow ports 220 and mix with the first fluid 130*a*, and thereby result in the fracturing fluid 128, which travels downward to the jet fracturing system 402 at 6100 psi. In the jet fracturing system 402, the fluid is accelerated thru the jets 406, which opens the fracture, but a portion of the fluid will flow back through the annulus 132 towards the first formation 104*a*, which may be sucked back into the pressure chamber 204 via the flow ports 220. This fluid rotation may provide the needed pressure differential across the 1000 ft interval. As the fluid is sucked back into the pressure booster 122, no proppant will be traveling above the first formation 104*a*, so no sticking will occur.

Embodiments disclosed herein include:

A. A well system that includes a wellbore lined with a wellbore lining, and a pressure booster extendable within the wellbore on a conveyance whereby an annulus is defined between the conveyance and the wellbore lining, the pressure booster including a body having a first end coupled to the conveyance, a jetting chamber defined within the body, one or more flow ports defined in the body and providing fluid communication between the jetting chamber and the annulus, and a jet nozzle in fluid communication with the conveyance, wherein the pressure booster receives a first fluid through the conveyance and a second fluid from the annulus and mixes the first and second fluids to discharge a fracturing fluid below the pressure booster at a pressure greater than a pressure within the annulus above the pressure booster.

B. A method that includes introducing a pressure booster on a conveyance into a wellbore lined with a wellbore lining, the pressure booster including a body having a first end coupled to the conveyance, a jetting chamber defined within the body, and a jet nozzle in fluid communication with the conveyance, conveying a first fluid at a first velocity and a first pressure to the jet nozzle via the conveyance, wherein an annulus is defined between the conveyance and the wellbore lining, conveying a second fluid at a second velocity and a second pressure to the pressure booster via the annulus, the first velocity being less than the second velocity and the first pressure being greater than the second pressure, discharging the first fluid from the jet nozzle at a third velocity greater than the second velocity and thereby drawing the second fluid into the jetting chamber via one or more flow ports defined in the body, mixing the first and second fluids and thereby generating a fracturing fluid, wherein the first fluid is one of a proppant slurry and a clean fluid and the second fluid is the other of the proppant slurry and the clean fluid, and discharging the fracturing fluid into the wellbore below the pressure booster at a third pressure greater than the second pressure.

C. A well system that includes a wellhead, a wellbore extending below the wellhead and being lined with a wellbore lining, and a pressure booster coupled to and extending through the wellhead, the pressure booster including a conveyance and a jet nozzle in fluid communication with the conveyance, wherein an annulus is defined between the conveyance and the wellbore lining and, one or more fluid conduits in fluid communication with the annulus and positioned below the wellhead, wherein a first fluid is conveyed to the jet nozzle via the conveyance at a first velocity and a first pressure, and a second fluid is provided to the annulus via the one or more fluid conduits at a second velocity and a second pressure, the first velocity being less than the second velocity and the first pressure being greater than the second pressure, and wherein the jet nozzle discharges the first fluid at a third velocity greater than the second velocity and the first and second fluids mix to generate a fracturing fluid below the pressure booster at a third pressure greater than the second pressure.

D. A method that includes conveying a first fluid to a pressure booster coupled to and extending through a wellhead having a wellbore extending therebelow, the wellbore being lined with a wellbore lining and the pressure booster including a conveyance and a jet nozzle in fluid communication with the conveyance, wherein the first fluid is conveyed to the jet nozzle via the conveyance at a first velocity and a first pressure, conveying a second fluid into an annulus defined between the conveyance and the wellbore lining at a second velocity and a second pressure via one or more fluid conduits in fluid communication with the annulus and positioned below the wellhead, wherein the first velocity is less than the second velocity and the first pressure is greater than the second pressure, discharging the first fluid from the jet nozzle at a third velocity greater than the second velocity, mixing the first and second fluids and thereby generating a fracturing fluid, wherein the first fluid is one of a proppant slurry and a clean fluid and the second fluid is the other of the proppant slurry and the clean fluid, and flowing the fracturing fluid into the wellbore below the pressure booster at a third pressure greater than the second pressure.

Each of embodiments A, B, C and D may have one or more of the following additional elements in any combination: Element 1: wherein the conveyance is selected from the group consisting of coiled tubing, production pipe, and drill pipe. Element 2: wherein the first fluid is one of a proppant slurry and a clean fluid and the second fluid is the other of the proppant slurry and the clean fluid. Element 3: wherein the first fluid is circulated through the conveyance to the jet nozzle at a first velocity and a first pressure, and the second fluid is circulated through the annulus to the pressure booster at a second velocity and a second pressure, the first velocity being less than the second velocity, and the first pressure being greater than the second pressure, wherein the jet nozzle discharges the first fluid at a third velocity greater than the second velocity and thereby draws the second fluid into the jetting chamber via the one or more flow ports, and wherein the fracturing fluid is provided to a portion of the wellbore below the pressure booster at a third pressure greater than the second pressure. Element 4: further comprising a sealing system coupled to the pressure booster, the sealing system including a housing coupled to a second end of the body of the pressure booster, a central flow passageway defined within the housing and in fluid communication with the jetting chamber, wherein a distal end of the central flow passageway is open to the wellbore, and at least one wellbore isolation device arranged about the housing and actuatable to sealingly engage an inner wall of the wellbore lining, wherein the fracturing fluid is discharged into the wellbore via the central flow passageway. Element 5: wherein the sealing system comprises a compression-set packer assembly. Element 6: wherein the jet nozzle is made of an erosion-resistant material selected from the group consisting of a carbide, tungsten carbide, boron carbide, a carbide embedded in a matrix of cobalt or nickel, a cobalt alloy, a ceramic, diamond, a surface hardened metal, and any combination thereof. Element 7: further comprising a jet fracturing system coupled to the pressure booster, the jet fracturing system including a jetting body coupled to a second end of the body of the pressure booster, one or more jets provided in the jetting body for discharging the fracturing fluid into the wellbore.

Element 8: wherein the wellbore penetrates at least a first formation and a second formation and the pressure booster is located within the wellbore between the first and second formations, the method further comprising hydraulically fracturing the second formation below the pressure booster with the fracturing fluid at the third pressure while the first formation is exposed to the second pressure in the annulus. Element 9: wherein a sealing system is coupled to the pressure booster and includes a housing coupled to a second end of the body, a central flow passageway defined within the housing and in fluid communication with the jetting chamber, and at least one wellbore isolation device arranged about the housing and actuatable to sealingly engage an inner wall of the wellbore lining, the method further comprising discharging the fracturing fluid into the wellbore via the central flow passageway. Element 10: wherein a jet fracturing system is coupled to the pressure booster and includes a jetting body coupled to a second end of the body and one or more jets provided in the jetting body, the method further comprising discharging the fracturing into the wellbore via the one or more jets.

Element 11: wherein the wellhead includes a frac head operatively coupled thereto and the pressure booster extends through the wellhead and the frac head. Element 12: wherein the conveyance is selected from the group consisting of coiled tubing, production pipe, drill pipe, and any fluid conduit. Element 13: wherein the first fluid is one of a proppant slurry and a clean fluid and the second fluid is the other of the proppant slurry and the clean fluid. Element 14: wherein the jet nozzle is made of an erosion-resistant material selected from the group consisting of a carbide, a carbide embedded in a matrix of cobalt or nickel, tungsten carbide, boron carbide, a cobalt alloy, a ceramic, a surface hardened metal, diamond, and any combination thereof.

Element 15: wherein discharging the first fluid from the jet nozzle at the third velocity comprises generating a pressure differential across the pressure booster that draws the second fluid to the first fluid for mixing. Element 16: wherein the wellbore penetrates at least one formation, the method further comprising hydraulically fracturing the at least one formation below the pressure booster with the fracturing fluid at the third pressure while the wellhead is exposed to the second pressure in the annulus.

By way of non-limiting example, exemplary combinations applicable to A, B, C and D include: Element 2 with Element 4; and Element 4 with Element 5.

Therefore, the disclosed systems and methods are well adapted to attain the ends and advantages mentioned as well as those that are inherent therein. The particular embodiments disclosed above are illustrative only, as the teachings of the present disclosure may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered, combined, or modified and all such variations are considered within the scope of the present disclosure. The systems and methods illustratively disclosed herein may suitably be practiced in the absence of any element that is not specifically disclosed herein and/or any optional element disclosed herein. While compositions and methods are described in terms of "comprising," "containing," or "including" various components or steps, the compositions and methods can also "consist essentially of" or "consist of" the various components and steps. All numbers and ranges disclosed above may vary by some amount. Whenever a numerical range with a lower limit and an upper limit is disclosed, any number and any included range falling within the range is specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values. Also, the terms in the claims have their plain, ordinary meaning unless otherwise explicitly and clearly defined by the patentee. Moreover, the indefinite articles "a" or "an," as used in the claims, are defined herein to mean one or more than one of the element that it introduces. If there is any conflict in the usages of a word or term in this specification and one or more patent or other documents that may be incorporated herein by reference, the definitions that are consistent with this specification should be adopted.

As used herein, the phrase "at least one of" preceding a series of items, with the terms "and" or "or" to separate any of the items, modifies the list as a whole, rather than each member of the list (i.e., each item). The phrase "at least one of" allows a meaning that includes at least one of any one of the items, and/or at least one of any combination of the items, and/or at least one of each of the items. By way of example, the phrases "at least one of A, B, and C" or "at least one of A, B, or C" each refer to only A, only B, or only C; any combination of A, B, and C; and/or at least one of each of A, B, and C.

The use of directional terms such as above, below, upper, lower, upward, downward, left, right, uphole, downhole and the like are used in relation to the illustrative embodiments as they are depicted in the figures, the upward direction being toward the top of the corresponding figure and the downward direction being toward the bottom of the corresponding figure, the uphole direction being toward the surface of the well and the downhole direction being toward the toe of the well.

What is claimed is:

1. A well system, comprising:

a wellbore lined with a wellbore lining; and a pressure booster extendable within the wellbore on a conveyance whereby an annulus is defined between the conveyance and the wellbore lining, the pressure booster including:

a body having a first end coupled to the conveyance;

a jetting chamber defined within the body;

one or more flow ports defined in the body and providing fluid communication between the jetting chamber and the annulus; and a jet nozzle in fluid communication with the conveyance, wherein the pressure booster receives a first fluid through the conveyance and a second fluid from the annulus and mixes the first and second fluids to discharge a fracturing fluid below the pressure booster at a pressure greater than a pressure within the annulus above the pressure booster;

a sealing system coupled to the pressure booster, the sealing system including:

a housing coupled to a second end of the body of the pressure booster;

a central flow passageway defined within the housing and in fluid communication with the jetting chamber, wherein a distal end of the central flow passageway is open to the wellbore; and at least one wellbore isolation device arranged about the housing and actuatable to sealingly engage an inner wall of the wellbore lining, wherein the fracturing fluid is discharged into the wellbore via the central flow passageway.

2. The well system of claim 1, wherein the conveyance is selected from the group consisting of coiled tubing, production pipe, and drill pipe.

3. The well system of claim 1, wherein the first fluid is one of a proppant slurry and a clean fluid and the second fluid is the other of the proppant slurry and the clean fluid.

4. The well system of claim 1, wherein the first fluid is circulated through the conveyance to the jet nozzle at a first velocity and a first pressure, and the second fluid is circulated through the annulus to the pressure booster at a second velocity and a second pressure, the first velocity being less than the second velocity, and the first pressure being greater than the second pressure, wherein the jet nozzle discharges the first fluid at a third velocity greater than the second velocity and thereby draws the second fluid into the jetting chamber via the one or more flow ports, and wherein the fracturing fluid is provided to a portion of the wellbore below the pressure booster at a third pressure greater than the second pressure.

5. The well system of claim 1, wherein the sealing system comprises a compression-set packer assembly.

6. The well system of claim 1, wherein the jet nozzle is made of an erosion-resistant material selected from the group consisting of a carbide, tungsten carbide, boron carbide, a carbide embedded in a matrix of cobalt or nickel, a cobalt alloy, a ceramic, diamond, a surface hardened metal, and any combination thereof.

7. The well system of claim 1, further comprising a jet fracturing system coupled to the pressure booster, the jet fracturing system including:

a jetting body coupled to a second end of the body of the pressure booster; and one or more jets provided in the jetting body for discharging the fracturing fluid into the wellbore.

* * * * *